US011030870B2

(12) United States Patent
Clark et al.

(10) Patent No.: US 11,030,870 B2
(45) Date of Patent: Jun. 8, 2021

(54) SYSTEM AND METHOD FOR TRIGGER SECURITY TAG DEACTIVATION USING MOBILE DEVICE

(71) Applicant: SENSORMATIC ELECTRONICS, LLC, Boca Raton, FL (US)

(72) Inventors: John Jay Clark, Boynton Beach, FL (US); Mikhail Polyakov, Boynton Beach, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 0 days.

(21) Appl. No.: 16/434,648

(22) Filed: Jun. 7, 2019

(65) Prior Publication Data

US 2020/0388125 A1 Dec. 10, 2020

(51) Int. Cl.
*G08B 13/24* (2006.01)

(52) U.S. Cl.
CPC ..... *G08B 13/242* (2013.01)

(58) Field of Classification Search
CPC ..... G08B 13/242; G08B 13/2411
See application file for complete search history.

(56) References Cited

U.S. PATENT DOCUMENTS 10,354,507 B1 * 7/2019 Lercari ..... G06F 16/288
2014/0085089 A1 * 3/2014 Rasband ..... G08B 13/246 340/572.1
2016/0364968 A1 * 12/2016 Sharpy ..... G08B 13/242

FOREIGN PATENT DOCUMENTS

WO WO-2015121833 A1 * 8/2015 ..... G06Q 20/354

* cited by examiner

*Primary Examiner* — Brian Wilson
(74) *Attorney, Agent, or Firm* — Arent Fox, LLP

(57) ABSTRACT

Aspects of the present disclosure provide techniques to deactivate security tags associated with purchased products via a mobile application by using the Near Field Communications (NFC) protocol or other near field wireless capabilities of the mobile device to communicate with a stand-alone deactivator. In some instances, the mobile device may be configured to deactivate either single tag ("single deactivation") or a plurality of tags ("bulk deactivation") using an authorization code. Features of the present disclosure provide advantages over conventional systems in terms of convenience for the customer and lower hardware requirements. Specifically, unlike current systems, the stand-alone deactivator of the present disclosure does not need to be part of or connected to the POS network to enable or inhibit the deactivation of security tags. The information needed to enable deactivation may be transferred to the deactivator using the NFC or other near field wireless capabilities of a mobile device.

16 Claims, 5 Drawing Sheets

300

400

SYSTEM AND METHOD FOR TRIGGER SECURITY TAG DEACTIVATION USING MOBILE DEVICE

BACKGROUND

The present disclosure relates generally to an Electronic Article Surveillance ("EAS") system, and more specifically to a method for deactivating security tags using mobile devices.

EAS systems are often used by retail stores in order to minimize loss due to theft. One common way to minimize retail theft is to attach a security tag to an article such that an unauthorized removal of the article can be detected. In some scenarios, a visual or audible alarm is generated based on such detection. For example, a security tag with an EAS element can be attached to an article offered for sale by a retail store. An EAS interrogation signal is transmitted at the entrance and/or exit of the retail store. The EAS interrogation signal causes the EAS element of the security tag to produce a detectable response if an attempt is made to remove the article without first detaching or deactivating the security tag.

A typical retail sales transaction occurs at a fixed point of sale ("POS") station manned by a store sales associate. The store sales associate assists a customer with the checkout process by receiving payment for an item. If the item is associated with an EAS element, such as an acoustic-magnetic ("A-M") tag, the store sales associate deactivates the security tag after the customer pays for the item.

In today's retail stores, mobile shopping applications and self-checkout solutions are becoming more prevalent. In some instances, customers may use a mobile shopping application (also referred to as "Mobile Point of Sale" (MPOS)) while the customer is physically at the store to purchase an item while bypassing the need to wait in line for a store sales associate to check-out the customer at the fixed POS station. However, in current systems, while the customer may be able to purchase the item using MPOS, the customer is still unable to deactivate the security tags or labels protecting certain products without waiting for the store sales associate to deactivate the security tag. Indeed, in current systems, the deactivator is tied to the fixed POS terminal and only enables the deactivation when there is a scanned universal product code (UPC). This requires the retailer to have the deactivator connected to the POS network either through the register or network to control the state of the deactivator to enable or inhibit its operation.

Connecting the deactivator to the POS network can be expensive and burdensome on the retailer. Thus, in conventional systems, the convenience of the mobile application checkout is defeated when the customer still has to stand in line to have security tags removed or deactivated.

SUMMARY

Aspects of the present disclosure provide techniques to deactivate security tags associated with purchased products via a mobile application by using the Near Field Communications (NFC) protocol or other near field wireless capabilities of the mobile device to communicate with a stand-alone deactivator. In some instances, the mobile device may be configured to deactivate either single tag ("single deactivation") or a plurality of tags ("bulk deactivation") using a deactivation code generated by the mobile point-of-sale application. Features of the present disclosure provide advantages over conventional systems in terms of convenience for the customer (e.g., customer not being required to wait for store sales associate) and lower hardware requirements. Specifically, unlike current systems, the stand-alone deactivator of the present disclosure does not need to be part of or connected to the POS network to enable or inhibit the deactivation of security tags. The information needed to enable deactivation may be transferred to the deactivator using the NFC or other near field wireless capabilities of a mobile device.

In one example, a method for deactivating security tags is disclosed. The method may comprise initiating a purchase transaction of at least one article via a mobile point-of-sale application being executed on a mobile device, wherein at least one article includes a security tag with an EAS element. The method may further comprise storing, at the mobile device, POS data associated with the purchase transaction. The method may further comprise generating a deactivation code to deactivate the security tag with the EAS element attached to the at least one article based at least in part on the POS data. The method may further comprise transmitting the deactivation code from the mobile device to a security tag deactivation station to deactivate the security tag.

In another example, an apparatus for deactivating security tags is disclosed. The apparatus may include a memory configured to store instructions and a processor communicatively coupled with the memory. The processor may be configured to execute the instructions to initiate a purchase transaction of at least one article via a mobile point-of-sale application being executed on a mobile device, wherein at least one article includes a security tag with an EAS element. The processor may further be configured to execute the instructions to store, at the mobile device, POS data associated with the purchase transaction. The processor may further be configured to execute the instructions to generate a deactivation code to deactivate the security tag with the EAS element attached to the at least one article based at least in part on the POS data. The processor may further be configured to execute the instructions to transmit the deactivation code from the mobile device to a security tag deactivation station to deactivate the security tag.

In another example, a non-transitory computer readable medium for deactivating security tags is disclosed. The computer readable medium may include code for initiating a purchase transaction of at least one article via a mobile point-of-sale application being executed on a mobile device, wherein at least one article includes a security tag with an EAS element. The computer readable medium may include code for storing, at the mobile device, POS data associated with the purchase transaction. The computer readable medium may include code for generating a deactivation code to deactivate the security tag with the EAS element attached to the at least one article based at least in part on the POS data. The computer readable medium may include code for transmitting the deactivation code from the mobile device to a security tag deactivation station to deactivate the security tag.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 1:
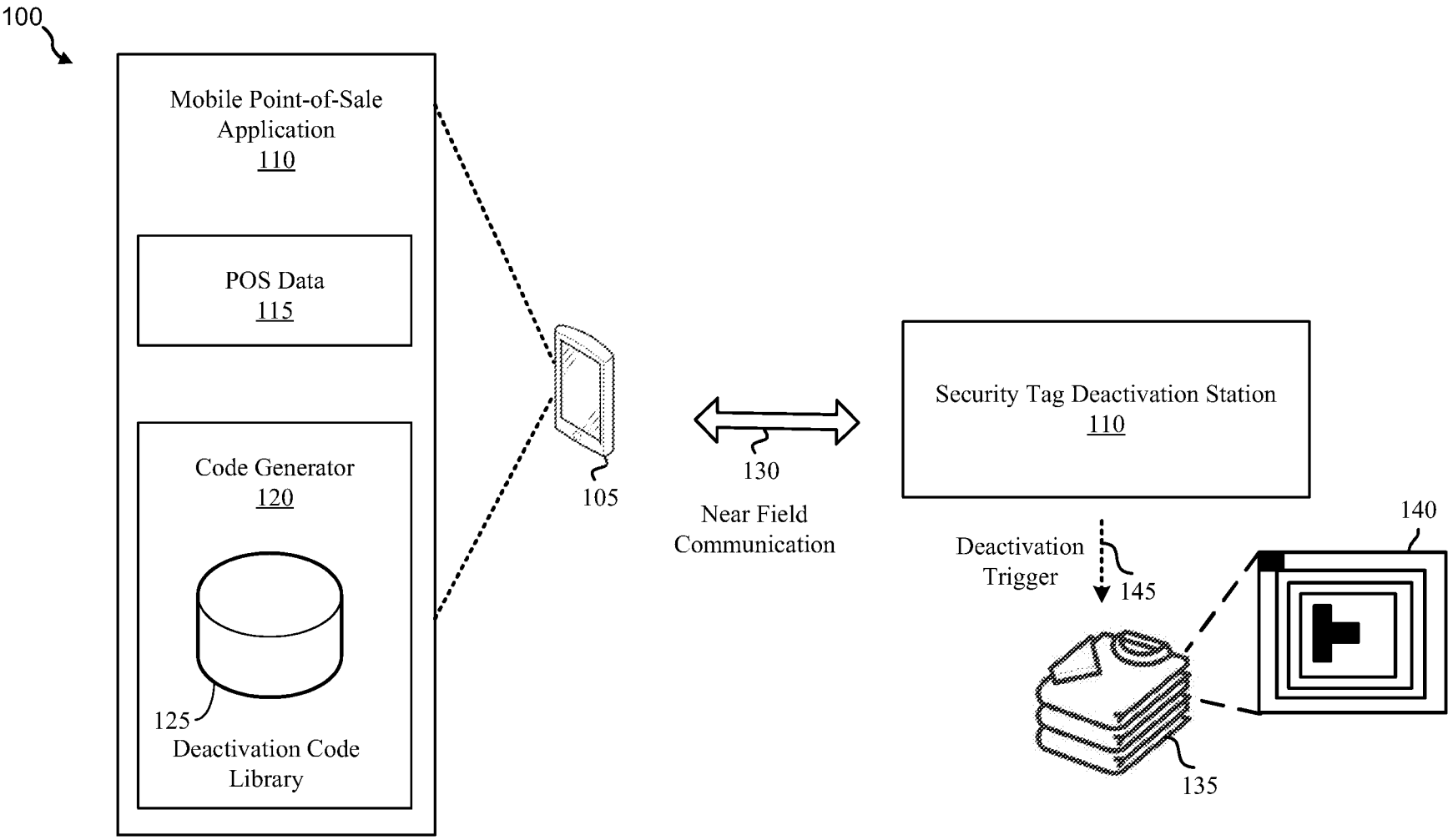
FIG. 1 is an example schematic diagram of an EAS system that allows a mobile device to utilize a mobile point-of-sale application to trigger deactivation of one or more security tags attached to one or more articles in accordance with aspects of the present disclosure.

As discussed above, in current systems, a typical retail sales transaction occurs at a fixed POS station manned by a store sales associate. The store sales associate assists a customer with the checkout process by receiving payment for an item. If the item is associated with a security tag, such as an A-M tag, the store sales associate deactivates the security tag after the customer pays for the item. However, in recent years, more retailers are offering mobile shopping applications (e.g., MPOS) and self-checkout capabilities to their customers. Such systems offer convenience to the customer who can bypass waiting in line for a store sales associate to purchase items at a fixed POS station.

However, in many instances, products that have high value or greater propensity for being stolen may be protected with security tags such that an unauthorized removal of the article from the property can be detected, thereby triggering a visual and/or audible alarm. Thus, in current systems, while the customer may be able to purchase one or more products using MPOS, for any product that includes security tags, the customer is still unable to deactivate such security tags or labels protecting without waiting for the store sales associate. This is because, in current systems, the deactivator is generally tied to the fixed POS terminal that only enables the deactivation when there is a scanned UPC. Connecting the deactivator to the POS terminal may further require the deactivator to be connected to the POS network either through the register or network in order to control the state of the deactivator that enables or inhibits its operation.

Such implementation can be expensive and burdensome on the retailers. Thus, in current systems, the lack of convenience of the mobile application when the customer is still required to stand in line to have security tags removed or deactivated, coupled with the hardware requirements of connecting the deactivator to the POS terminal and the backend POS network renders conventional systems impractical.

Aspects of the present disclosure solve the above-identified problem by introducing techniques to deactivate one or more security tags associated with one or more purchased products via a mobile application by using the NFC protocol or other near field wireless capabilities of the mobile device to communicate with a stand-alone deactivator. In some instances, the mobile device may be configured to deactivate either single security tag ("single deactivation") or a plurality of security tags ("bulk deactivation") using a deactivation code. Features of the present disclosure provide advantages over conventional systems in terms of convenience for the customer (e.g., customer is not being required to wait for store sales associate) and lower hardware requirements. Specifically, unlike current systems, the stand-alone deactivator of the present disclosure does not need to be part of or connected to the POS network to enable or inhibit the deactivation of security tags. The information needed to enable deactivation may be transferred to the deactivator using the NFC or other near field wireless capabilities of a mobile device.

Various aspects are now described in more detail with reference to the FIGS. 1-4. In the following description, for purposes of explanation, numerous specific details are set forth in order to provide a thorough understanding of one or more aspects. It may be evident, however, that such aspect(s) may be practiced without these specific details. Additionally, the term "component" as used herein may be one of the parts that make up a system, may be hardware, firmware, and/or software stored on a computer-readable medium, and may be divided into other components.

The following description provides examples, and is not limiting of the scope, applicability, or examples set forth in the claims. Changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in other examples.

FIG. 1 is a schematic diagram 100 of an EAS system that allows a mobile device 105 to utilize a mobile point-of-sale application 110 to trigger deactivation of one or more security tags 140 attached to one or more articles 135. In some examples, one or more security tags 140 may be attached to articles 135 or merchandise for sale (e.g., clothes, power tools, battery packs etc.) to protect the articles 135 from an unauthorized removal from the retail store facility. In some examples, the EAS system allows for a monitoring system that establishes a surveillance zone within which the presence of the security tag 140 can be detected. If the security tag 140 is carried outside of a surveillance zone, an alarm may be triggered to indicate a possible unauthorized removal of the articles 135 from the retail store facility.

In some instances, a customer may desire to purchase the one or more articles 135. The customer may purchase the articles 135 using a point of sale ("POS"). The POS can include, but is not limited to a mobile POS device 105, a mobile POS station, a self-checkout POS station, etc. In the MPOS scenarios, the mobile device 105 may comprises a handheld communication device running a retail transaction application (e.g., mobile point-of-sale application 110). The mobile device 105 includes, but is not limited to, a cellular phone, a smart phone, a portable computer, a tablet, or a personal digital assistant.

In some examples, after the mobile point-of-sale application 110 is launched on the mobile device 105, the customer may be prompted to start a retail transaction process for purchasing the articles 135. The retail transaction process can be started by performing a user software interaction, such as depressing a key on a keypad of the mobile device 105 or touching a button on a touch screen display of the mobile device 105.

A retail transaction application (e.g., mobile point of sale application 110) executing on the mobile device 105 may facilitate the exchange of data between one or more of the mobile device 105, and/or a Retail Transaction System ("RTS"). Additionally or alternatively, the mobile device 105 may include capability of scanning or inputting the UPC (or other unique identifier) associated with the articles 135 for the purchase. For example, the customer may either manually input the unique article identifier (e.g., UPC) of the articles and quantity of purchase and/or use one or more of camera to scan the UPC or the image of the article 135 to initiate the retail transaction. In addition to the manual or camera capture, the information regarding the article may also be communicated from the article 135 to the mobile device 105 (the mobile point-of-sale application 110) via wireless communication, such as a barcode communication, RFID communication or NFC.

After the mobile point-of-sale application 110 executing on the mobile device 105 obtains the article information, payment information is input into the retail transaction application. The payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the mobile point-of-sale application 110 may perform operations for establishing a retail transaction session with the RTS. The retail transaction session can involve: communicating the article information and payment information from the mobile device 105 (and more particularly from the mobile point-of-sale application 110) to the RTS (not shown) via a public or private network (e.g., the Internet), completing a purchase transaction by the RTS, and receiving a response message (e.g., confirmation or receipt) from the RTS to the mobile point-of-sale application 110 indicating that the one or more articles 135 has been successfully or unsuccessfully purchased. The purchase transaction can involve using an authorized payment system, such as a bank Automatic Clearing House ("ACH") payment system, a credit/debit card authorization system, or a third party system.

The purchase transaction can be completed by the RTS using the article information and payment information. In this regard, such information may be received by the RTS and forwarded thereby to a sub-system of a private network (e.g., an Intranet). For example, the article information and purchase information can also be forwarded to and processed by a purchase sub-system to complete a purchase transaction. When the purchase transaction is completed, a message is generated and sent to the mobile device 105 indicating whether the article 135 has been successfully or unsuccessfully purchased.

The article information, the quantity (e.g., number of jeans purchased), payment information, confirmation information, and/or any other information associated with the purchase transaction (collectively "POS data" 115) may be stored in the memory of the mobile device 105 associated with the mobile point-of-sale application 110. Once the purchase of the one or more articles is completed via the mobile point-of-sale application 110, the mobile point-of-sale application 110 may transmit the POS data 115 to a deactivation code library 125 in order to generate (via the code generator 120) a deactivation code to deactivate one or more security tags 140 at the security tag deactivation station 110.

In some examples, the mobile point-of-sale application 110 may supply POS data 115, along with additional information such as the identification (ID) of the security tag deactivation station 110 that the mobile device 110 is near or at. The security tag deactivation station ID may be determined by identifying the location of the mobile device in relationship to the known positions of the one or more security tag deactivation stations 110 in the retail store, or by allowing the customer to enter or scan the ID (e.g., bar code) on the security tag deactivation station. In contrast to the conventional systems, the security tag deactivation station 110 of the present disclosure may be a standalone "deactivator" that is not connected to any particular POS station. Instead, the security tag deactivation station 110 may be one or more unattended self-checkout stations that may be located throughout the retail space to allow customers to walk up to and deactivate security tags 140 when the customer has purchased one or more articles 135 using a mobile point-of-sale application 110 on a mobile device 105.

Upon receiving the POS data 115 and the security tag deactivation station ID information, the code generator 120 may rely on the deactivation code library 125 to generate a deactivation code needed to deactivate one or more security tags 140. For security purposes, the deactivation code that is generated may be encrypted and valid for only single use such that if there are any NFC sniffers present in the vicinity, the deactivation code could not be decoded or reused for malicious purposes. In some instances, the deactivation code may only be valid for the specific security tag deactivation station 110 because the deactivation code is ad-hoc generated based on one or more parameters, including the ID of the security tag deactivation station.

Once the deactivation code is generated, the customer may be instructed to "tap" or bring the mobile device 105 in close proximity to the security tag deactivation station 110 such that the deactivation code can be communicated 130 from the mobile device 105 to the security tag deactivation station 110. The security tag deactivation station 110 may validate the deactivation code and either enables or inhibits deactivation of one or more security tags 140. The security tag deactivation station 110 may also count the number of deactivations and restrict that number to no more than the number of articles 135 that are purchased or tagged in the POS data 115.

In some instances, the security tag deactivation station 110 may be a "bulk deactivator" that is configured to deactivate a plurality of security tags 140 based on a single deactivation code received from the mobile point-of-sale application 110. In such instance, after the customer purchases the one or more articles 135, the customer may go to a security tag deactivation station 110 with plurality of articles that all include security tags 140. The customer may place all the items into the bulk deactivator and the security tag deactivation station 110 may count the number of tags being placed in the bulk deactivator bin (e.g., a holder where a customer may insert or drop the one or more articles that can then automatically allow the security tag deactivation station 110 to detect the number of security tags and products that are present in the deactivator bin). As such, when the mobile point-of-sale application 110 transmits the deactivation code to the security tag deactivation station 110 via the NFC 130, the security tag deactivation station 110 may enable bulk deactivation if the number of security tags equals or is less than the number of articles 135 purchased or tagged. If the number of security tags in the bulk deactivator bin exceeds the number of articles 135 purchased, the security tag deactivation station 110 disable bulk deactivation and trigger a visual and/or audio notification to indicate that too many articles are in the bin.

Figure 2A:
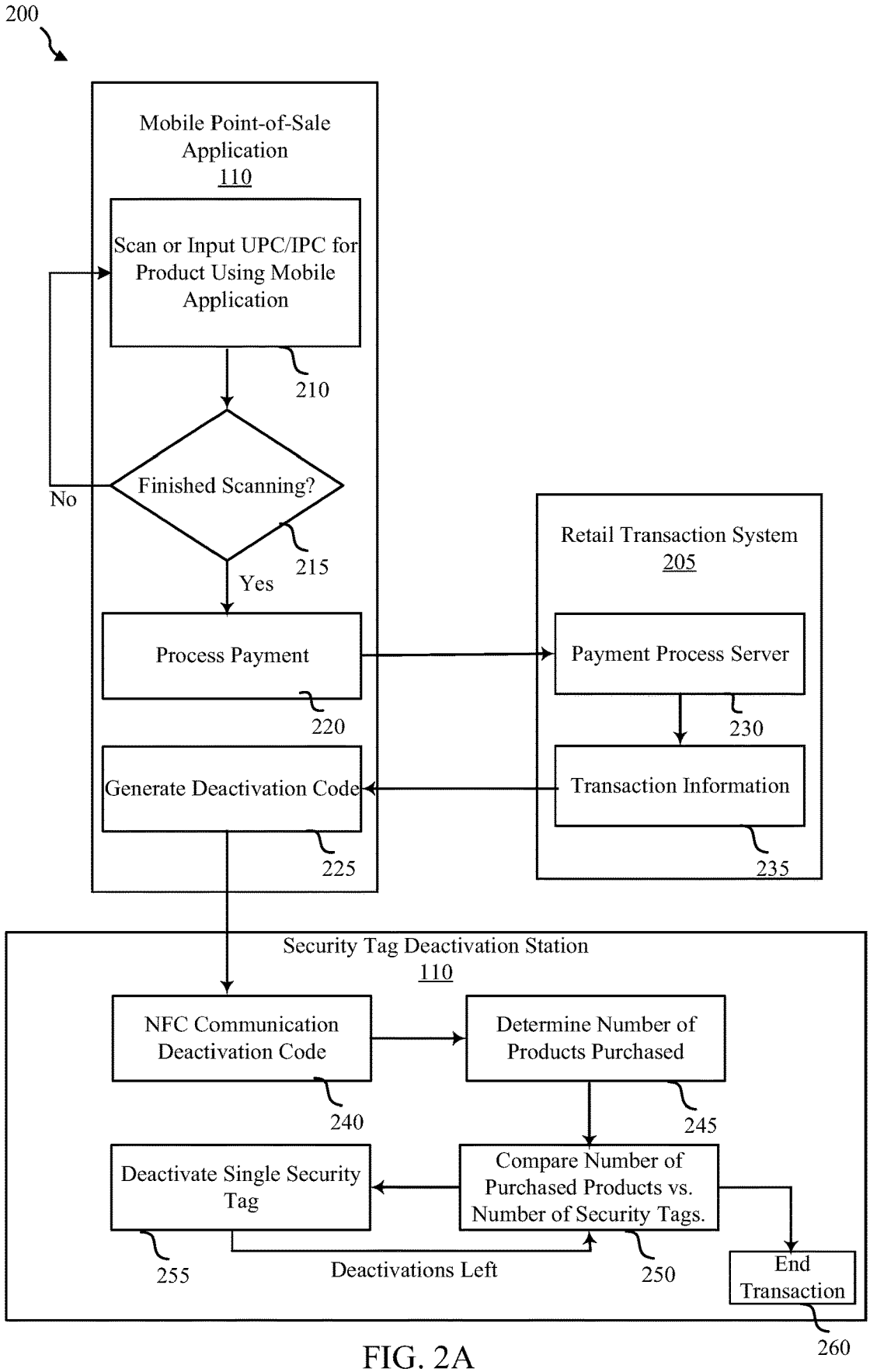
FIG. 2A is an example flowchart illustrating a single deactivation system to deactivate one or more security tags via a mobile device in accordance with aspects of the present disclosure.

FIG. 2A is a flowchart 200 illustrating a single deactivation system to deactivate one or more security tags via a mobile device in accordance with aspects of the present disclosure. In some examples, the method may start when the user or customer initiates the mobile point-of-sale application 110 on a mobile device 105 to purchase one or more articles (e.g., clothes, tools, battery, candy, household goods, etc.) that may be in a retail store. The user may elect to use the mobile point-of sale application 110 as means to checkout for sale without the need to wait in line for a sales associate at a fixed POS station. However, as discussed above, in some instances one or more articles may have a security tag attached thereto to prevent theft. In such instances, features of the present disclosure may still allow the use of mobile device 105 for the purchase transaction and deactivation of the security tag from a security tag deactivation station 110 that is not connected to any fixed POS system or backend POS network.

To this end, the retail transaction application (e.g., mobile point of sale application 110) executing on the mobile device 105 may facilitate the exchange of data between the mobile device 105 and RTS of a corporate facility to process payment and transaction. Thus, at block 210, the method may include scanning or inputting the unique article identifier for products to be purchased using the mobile application. For example, the mobile device 105 may include capability of scanning or inputting the UPC (or other unique identifier) associated with the articles 135 for purchase. The customer may either manually input the unique article identifier (e.g., UPC) of the articles and quantity of purchase and/or use one or more of camera to scan the UPC or the image of the article 135 to initiate the retail transaction. In addition to the manual or camera capture, the information regarding the article may also be communicated from the article 135 to the mobile device 105 (the mobile point-of-sale application 110) via wireless communication, such as a barcode communication, RFID communication or NFC. At block 215, the method may include determining whether the customer has finished scanning or inputting all the product intended for purchase (e.g., completing the virtual cart). If the customer has not finished, the method may return back to block 210 to continue allowing the user to enter/scan additional UPC. However, if the customer has finished and proceeds to payment, the method may process payment at block 220.

As discussed above, the payment information can include, but is not limited to, a customer loyalty code, payment card information, and/or payment account information. The payment information can be input manually, via an electronic card reader (e.g., a magnetic strip card reader), or via a barcode reader. Electronic card readers and barcode readers are well known in the art, and therefore will not be described herein. Any known or to be known electronic card reader and/or barcode reader can be used herein without limitation. The payment information can alternatively or additionally be obtained from a remote data store based on a customer identifier or account identifier. In this case, the payment information can be retrieved from stored data associated with a previous sale of an article to the customer.

Upon obtaining the payment information, the mobile point-of-sale application 110 may establish a retail transaction session with the RTS 205 by transmitting the payment and product/article information to the payment process server 230. At 230, the payment process server 230 may process the payment for the one or more articles identified in the article information transmitted from the mobile point-of-sale application 110. The purchase transaction can involve using an authorized payment system, such as a bank ACH payment system, a credit/debit card authorization system, or a third party system. If the payment is successful, the RTS 205 may transmit the transaction information 235 back to the mobile device 105. The transmission may be over a wireless network, including but not limited to cellular network, Wi-Fi, etc.

At block 225, the mobile point-of-sale application 110 may generate an encrypted single use deactivation code 225 based in part on one or more of the transaction information that includes the POS data, the payment data, and the security tag deactivation station ID. Once the deactivation code is generated, the customer may proceed to "tap" (bring the mobile device 105 to close proximity to the security tag deactivation station 110) such that the deactivation code can be transmitted to the security tag deactivation station 110 via the NFC communication 240. Upon receiving the deactivation code, the security tag deactivation station 110 may decode the deactivation code or data to determine the encrypted deactivation code and at least one transaction information (e.g., number of products purchased or the list of products purchased).

At block 245, the security tag deactivation station 110 may count the number of articles that the user has placed in the deactivation bin associated with the security tag deactivation station 110 and also determine the number of products purchased via the transaction information. At block 250, as the customer presents the purchased products to the deactivator and the product is deactivated, station 110 may compare the number of purchased products against the number of security tags that have already been detected and deactivated. If the number of security tags detected and deactivated is less than the number of products purchased, the security tag deactivation station 110 may, at block 255, enable deactivation of a single security tag and decrements the number of available deactivations. If there are additional products left to be deactivated, the process may return to block 250 where the security tag deactivation station 110 determines whether additional security tags remain and if the number of available deactivations exceeds the number of security tags left to deactivate. The process of deactivation continues until such time that the number of available deactivations reaches zero when the security tag deactivation station 110 ends the transaction at block 260.

Figure 2B:
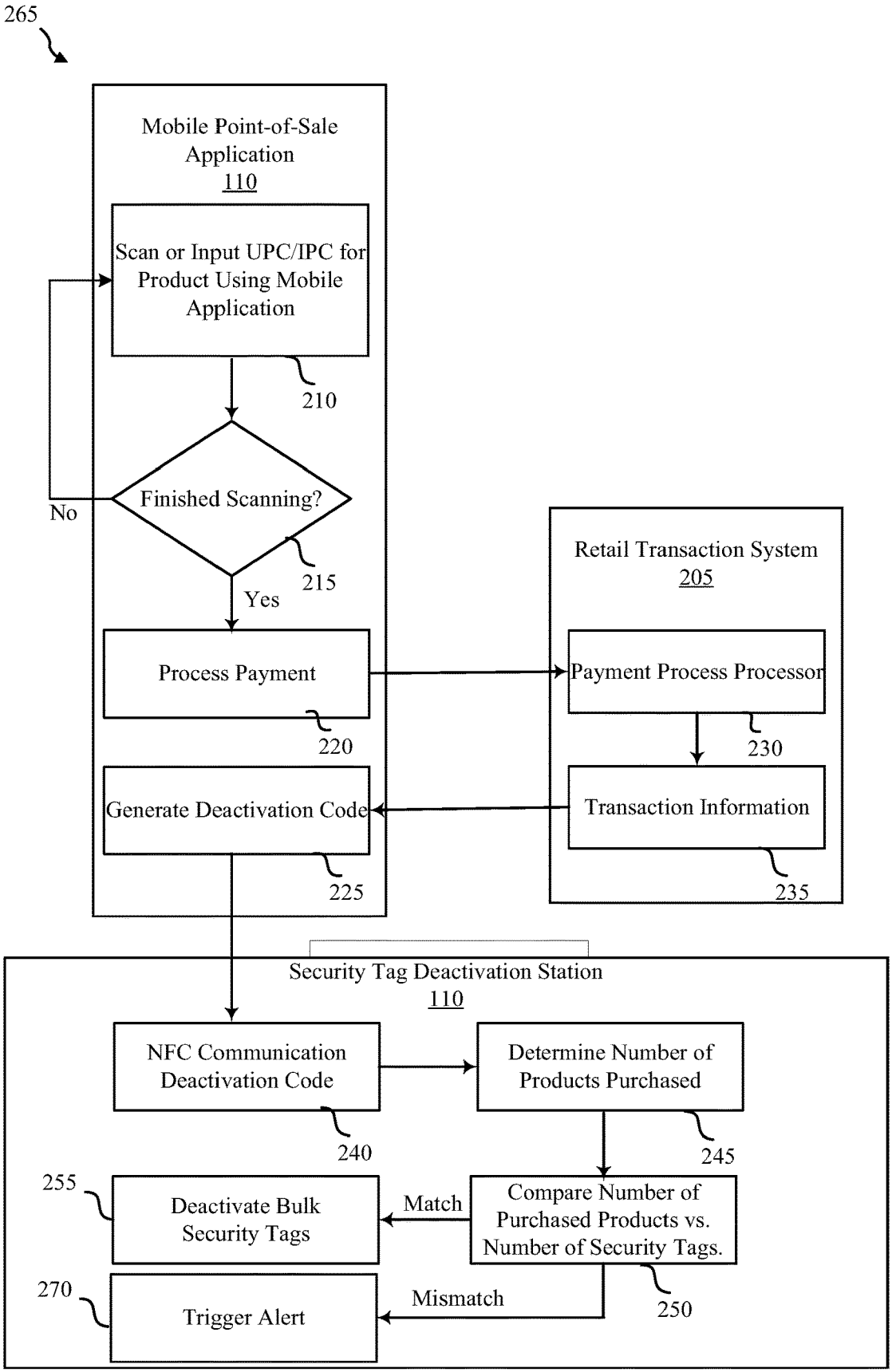
FIG. 2B is an example flowchart illustrating a bulk deactivation system to deactivate a plurality of security tags via a mobile device in single instance in accordance with aspects of the present disclosure.

FIG. 2B is a flowchart 265 illustrating a bulk deactivation system to deactivate a plurality of security tags via a mobile device in single instance in accordance with aspects of the present disclosure. The steps outlined in FIG. 2A for the purposes of the mobile application 110 and the RTS 205 remain the same for the bulk deactivation and thus are not repeated again for discussion of FIG. 2B for sake of brevity. However, in flowchart 265, the security tag deactivation station 110, when performing the bulk deactivation (i.e., deactivating a plurality of security tags in one instance as opposed to by determining the number of available deactivations), may compare the number of purchased products against the number of security tags detected in the deactivation bin at block 250. If the number of purchased products is equal to the number of security tags, the security tag deactivation station 110 may enable bulk deactivation of security tags at block 255. However, if the number of purchased products is not equal (or mismatches) to the number of security tags (e.g., when the number of security tags exceeds number of purchased products), the method 265 may trigger a visual or audio alert at 270 to notify the customer or sales associate that there may be products in the bin that have not been purchased.

Figure 3:
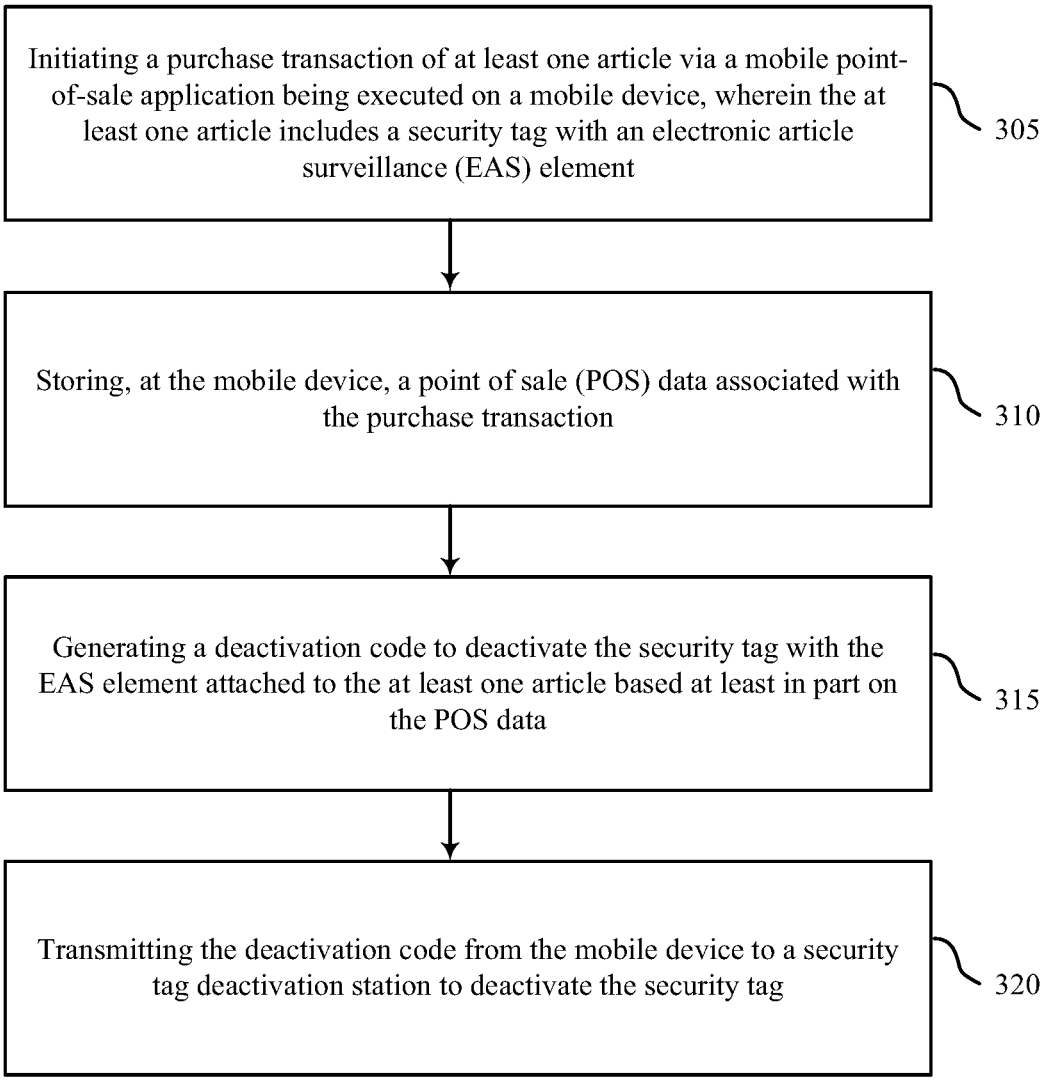
FIG. 3 is an example flowchart for an EAS system that allows deactivation of one or more security tags via a mobile device in accordance with aspects of the present disclosure.

FIG. 3 is flowchart 300 for deactivating security tags in accordance with aspects of the present disclosure. Aspects of flowchart 300 may be performed by the mobile device 105 as described with reference to FIG. 1 and FIG. 4.

At block 305, the method 300 may include initiating a purchase transaction of at least one article via a mobile point-of-sale application being executed on a mobile device, wherein the at least one article includes a security tag with an electronic article surveillance (EAS) element. Aspects of block 305 may be performed by mobile point-of-sale application 110 and communications component 415 described with reference to FIGS. 1 and 4.

At block 310, the method 300 may include storing, at the mobile device, a point of sale (POS) data associated with the purchase transaction. Aspects of block 310 may be performed by the memory 410 described with reference to FIG. 4.

At block 315, the method 300 may include generating a deactivation code to deactivate the security tag with the EAS element attached to the at least one article based at least in part on the POS data. In some examples, generating the deactivation code may comprise identifying number of articles purchased from the POS data, wherein the at least one article each has a unique identifier and determining an identification (ID) of the security tag deactivation station that is near the mobile device. The method further include generating the deactivation code based at least in part on the number of articles purchased and the ID of the security tag deactivation station. In some examples, the deactivation code may be a single use encrypted string that is uniquely generated by the mobile point-of-sale application for each purchase transaction. In some further examples, the deactivation code may be configured to deactivate a plurality of security tags associated with a plurality of articles (e.g., bulk deactivation). Aspects of block 315 may be performed by code generator 120 described with reference to FIGS. 1 and 4.

At block 320, the method 300 may include transmitting the deactivation code from the mobile device to a security tag deactivation station to deactivate the security tag. In some examples, the transmission may be performed by near field communication. Aspects of block 320 may be performed by communications component 415 described with reference to FIG. 4.

Figure 4:
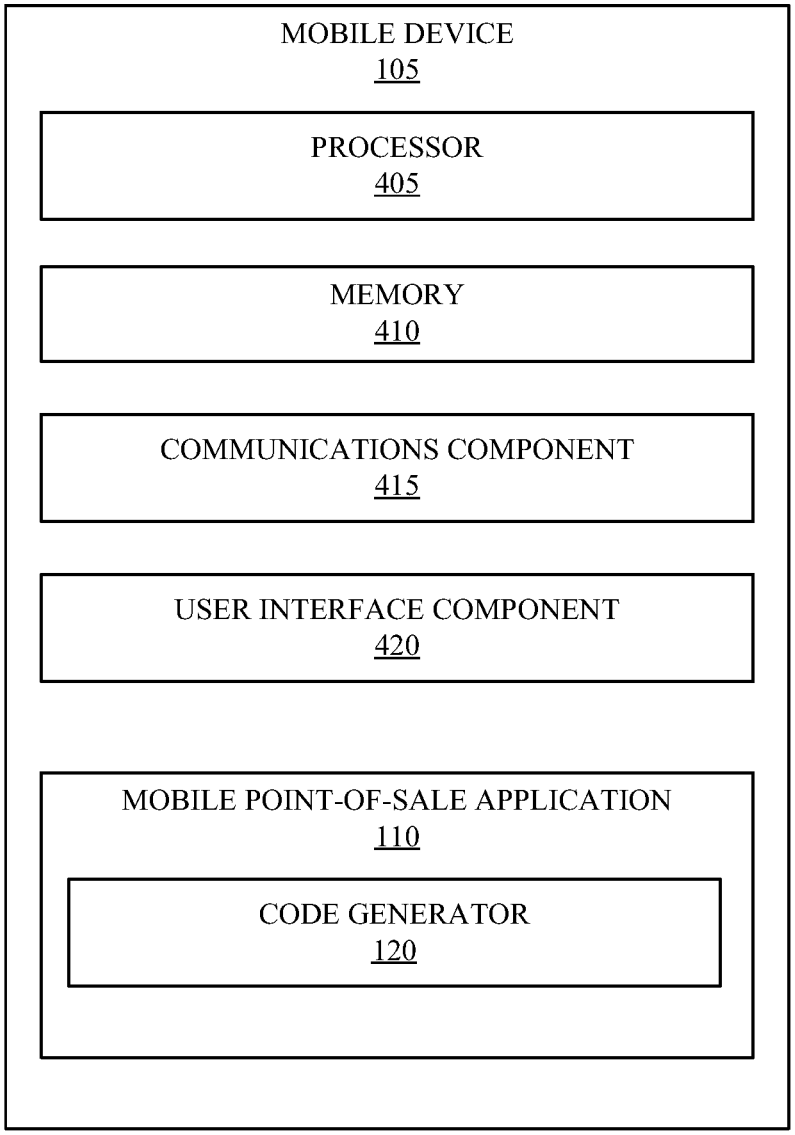
FIG. 4 is diagram illustrating an example of a hardware implementation for the mobile device in accordance with various aspects of the present disclosure.

Referring now to FIG. 4, a diagram illustrating an example of a hardware implementation for the mobile device 105 in accordance with various aspects of the present disclosure is described.

The mobile device 105 may include a processor 405 for carrying out one or more processing functions (e.g., method 300) described herein. The processor 405 may include a single or multiple set of processors or multi-core processors. Moreover, the processor 405 can be implemented as an integrated processing system and/or a distributed processing system.

The mobile device 105 may further include a memory 410, such as for storing local versions of applications being executed by the processor 405. In some aspects, the memory 410 may be implemented as a single memory or partitioned memory. In some examples, the operations of the memory 310 may be managed by the processor 405. Memory 410 can include a type of memory usable by a computer, such as random access memory (RAM), read only memory (ROM), tapes, magnetic discs, optical discs, volatile memory, non-volatile memory, and any combination thereof. Additionally, the processor 405, and memory 410, may include and execute operating system (not shown).

Further, the mobile device 105 may include a communications component 415 that provides for establishing and maintaining communications with one or more parties utilizing hardware, software, and services as described herein. Communications component 415 may carry communications between components and modules of the mobile device 105. The communications component 415 may also facilitate communications with external devices to the mobile device 105, such as to electronic devices coupled locally to the mobile device 105 and/or located across a communications network and/or devices serially or locally connected to the mobile device 105. For example, communications component 415 may include one or more buses operable for interfacing with external devices.

The mobile device 105 may include a user interface component 420 operable to receive inputs from a user of the mobile device 105 and further operable to generate outputs for presentation to the user. The user interface component 400 may include one or more input devices, including but not limited to a navigation key, a function key, a microphone, a voice recognition component, any other mechanism capable of receiving an input from a user, or any combination thereof. Further, user interface component 420 may include one or more output devices, including but not limited to a display, a speaker, any other mechanism capable of presenting an output to a user, or any combination thereof.

The mobile device 105 may further include a mobile point-of-sale application 110 to initiate and complete a purchase transaction for one or more articles in accordance with aspects of the present disclosure. The mobile point-of-sale application 110 may further include a code generator 120 to generate a deactivation code that is transmitted to the security tag deactivation station to deactivate one or more security tags.

As used in this application, the terms "component," "module," "system" and the like are intended to include a computer-related entity, such as but not limited to hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computer device and the computer device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets, such as data from one component interacting with another component in a local system, distributed system, and/or across a network such as the Internet with other systems by way of the signal.

Furthermore, various aspects are described herein in connection with a device, which can be a wired device or a wireless device. A wireless device may be a handheld RFID reader, a mobile device, cellular telephone, a satellite phone, a cordless telephone, a Session Initiation Protocol (SIP) phone, a wireless local loop (WLL) station, a personal digital assistant (PDA), a handheld device having wireless connection capability, a computer device, or other processing devices connected to a wireless modem.

It is understood that the specific order or hierarchy of blocks in the processes/flow charts disclosed is an illustration of exemplary approaches. Based upon design preferences, it is understood that the specific order or hierarchy of blocks in the processes/flow charts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

It should be appreciated to those of ordinary skill that various aspects or features are presented in terms of systems that may include a number of devices, components, modules, and the like. It is to be understood and appreciated that the various systems may include additional devices, components, modules, etc. and/or may not include all of the devices, components, modules etc. discussed in connection with the figures.

The various illustrative logics, logical blocks, and actions of methods described in connection with the embodiments disclosed herein may be implemented or performed with a specially-programmed one of a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computer devices, e.g., a combination of a DSP and a microprocessor, a plurality of microprocessors, one or more microprocessors in conjunction with a DSP core, or any other such configuration. Additionally, at least one processor may comprise one or more components operable to perform one or more of the steps and/or actions described above.

Further, the steps and/or actions of a method or algorithm described in connection with the aspects disclosed herein may be embodied directly in hardware, in a software module executed by a processor, or in a combination of the two. A software module may reside in RAM memory, flash memory, ROM memory, EPROM memory, EEPROM memory, registers, a hard disk, a removable disk, a CD-ROM, or any other form of storage medium known in the art. An exemplary storage medium may be coupled to the processor, such that the processor can read information from, and write information to, the storage medium. In the alternative, the storage medium may be integral to the processor. Further, in some aspects, the processor and the storage medium may reside in an ASIC. Additionally, the ASIC may reside in a user terminal. In the alternative, the processor and the storage medium may reside as discrete components in a user terminal. Additionally, in some aspects, the steps and/or actions of a method or algorithm may reside as one or any combination or set of codes and/or instructions on a machine readable medium and/or computer readable medium, which may be incorporated into a computer program product.

In one or more aspects, the functions described may be implemented in hardware, software, firmware, or any combination thereof. If implemented in software, the functions may be stored or transmitted as one or more instructions or code on a computer-readable medium. Computer-readable media includes both computer storage media and communication media including any medium that facilitates transfer of a computer program from one place to another. A storage medium may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection may be termed a computer-readable medium. For example, if software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave may be included in the definition of medium. Disk and disc, as used herein, includes compact disc (CD), laser disc, optical disc, digital versatile disc (DVD), floppy disk and Blu-ray disc where disks usually reproduce data magnetically, while discs usually reproduce data optically with lasers. Combinations of the above should also be included within the scope of computer-readable media.

The previous description of the disclosure is provided to enable a person skilled in the art to make or use the disclosure. Various modifications to the disclosure will be readily apparent to those skilled in the art, and the common principles defined herein may be applied to other variations without departing from the spirit or scope of the disclosure. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise. Thus, the disclosure is not to be limited to the examples and designs described herein but is to be accorded the widest scope consistent with the principles and novel features disclosed herein.

What is claimed is:

1. A method for deactivating security tags, comprising:

initiating a purchase transaction of at least one article via a mobile point-of-sale application being executed on a mobile device of a customer, wherein the at least one article includes a security tag with an electronic article surveillance (EAS) element;

storing, at the mobile device, a point of sale (POS) data associated with the purchase transaction;

generating, at the mobile device, an ad-hoc deactivation code to deactivate the security tag with the EAS element attached to the at least one article based at least in part on an identifier of a security tag deactivation station; and transmitting the deactivation code from the mobile device to the security tag deactivation station to deactivate the security tag.

2. The method of claim 1, wherein generating the deactivation code to deactivate the security tag based at least in part on the identifier of the security tag deactivation station, comprises:

identifying a number of articles purchased from the POS data, wherein the at least one article has a unique identifier;

determining the identifier of the security tag deactivation station that is near the mobile device; and generating the deactivation code based at least in part on the number of articles purchased and the identifier of the security tag deactivation station.

3. The method of claim 1, wherein the deactivation code is a single use encrypted string that is uniquely generated by the mobile point-of-sale application for each purchase transaction.

4. The method of claim 1, wherein the deactivation code is configured to deactivate a plurality of security tags associated with a plurality of purchased articles.

5. The method of claim 1, wherein transmitting the deactivation code from the mobile device to the security tag deactivation station, comprises:

enabling near field communication between the mobile device and the security tag deactivation station to transmit the deactivation code.

6. An apparatus for deactivating security tags, comprising:

a memory configured to store instructions; and a processor communicatively coupled with the memory, the processor configured to execute the instructions to:

initiate a purchase transaction of at least one article via a mobile point-of-sale application being executed on a mobile device of a customer, wherein the at least one article includes a security tag with an electronic article surveillance (EAS) element;

store, at the mobile device, a point of sale (POS) data associated with the purchase transaction;

generate, at the mobile device, an ad-hoc deactivation code to deactivate the security tag with the EAS element attached to the at least one article based at least in part on an identifier of a security tag deactivation station; and transmit the deactivation code from the mobile device to the security tag deactivation station to deactivate the security tag.

7. The apparatus of claim 6, wherein the instructions to generate the deactivation code to deactivate the security tag based at least in part on the identifier of the security tag deactivation station are further executable by the processor to:

identify a number of articles purchased from the POS data, wherein the at least one article has a unique identifier;

determine the identifier of the security tag deactivation station that is near the mobile device; and generate the deactivation code based at least in part on the number of articles purchased and the identifier of the security tag deactivation station.

8. The apparatus of claim 6, wherein the deactivation code is a single use encrypted string that is uniquely generated by the mobile point-of-sale application for each purchase transaction.

9. The apparatus of claim 6, wherein the deactivation code is configured to deactivate a plurality of security tags associated with a plurality of purchased articles.

10. The apparatus of claim 6, wherein transmitting the deactivation code from the mobile device to the security tag deactivation station, comprises:

enabling near field communication between the mobile device and the security tag deactivation station to transmit the deactivation code.

11. A non-transitory computer readable medium for deactivating security tags, comprising code for:

initiating a purchase transaction of at least one article via a mobile point-of-sale application being executed on a mobile device of a customer, wherein the at least one article includes a security tag with an electronic article surveillance (EAS) element;

storing, at the mobile device, a point of sale (POS) data associated with the purchase transaction;

generating, at the mobile device, an ad-hoc deactivation code to deactivate the security tag with the EAS element attached to the at least one article based at least in part on an identifier of a security tag deactivation station; and transmitting the deactivation code from the mobile device to the security tag deactivation station to deactivate the security tag.

12. The computer readable medium of claim 11, wherein the code for generating the deactivation code to deactivate the security tag based at least in part on the identifier of the security tag deactivation station, further comprises code for:

identifying a number of articles purchased from the POS data, wherein the at least one article has a unique identifier;

determining the identifier of the security tag deactivation station that is near the mobile device; and generating the deactivation code based at least in part on the number of articles purchased and the identifier of the security tag deactivation station.

13. The non-transitory computer readable medium of claim 11, wherein the deactivation code is a single use encrypted string that is uniquely generated by the mobile point-of-sale application for each purchase transaction.

14. The non-transitory computer readable medium of claim 11, wherein the deactivation code is configured to deactivate a plurality of security tags associated with a plurality of purchased articles.

15. The non-transitory computer readable medium of claim 11, wherein the code for transmitting the deactivation code from the mobile device to the security tag deactivation station, further comprises code for:

enabling near field communication between the mobile device and the security tag deactivation station to transmit the deactivation code.

16. A method for deactivating security tags, comprising:

initiating a purchase transaction of at least one article via a mobile point-of-sale application being executed on a mobile device, wherein the at least one article includes a security tag with an electronic article surveillance (EAS) element;

storing, at the mobile device, a point of sale (POS) data associated with the purchase transaction;

identifying a number of articles purchased from the POS data, wherein the at least one article has a unique identifier;

determining an identification (ID) of a security tag deactivation station that is near the mobile device;

generating a deactivation code to deactivate the security tag with the EAS element attached to the at least one article based at least in part on the POS data, the number of articles purchased, and the ID of the security tag deactivation station; and transmitting the deactivation code from the mobile device to the security tag deactivation station to deactivate the security tag.

* * * * *